US005615447A

United States Patent [19]

Hardesty et al.

[11] Patent Number: 5,615,447

[45] Date of Patent: Apr. 1, 1997

[54] PORTABLE CLEANING CONTAINER HAVING FOOT ACTIVATED DRAIN

[75] Inventors: Doug Hardesty, Norton, Ohio; William A. LaFollette, Jr., Stephens City, Va.

[73] Assignee: Rubbermaid Commercial Products Inc., Winchester, Va.

[21] Appl. No.: 427,753

[22] Filed: Apr. 24, 1995

[51] Int. Cl.[6] ..... A47J 47/18; A47L 13/50

[52] U.S. Cl. ..... 15/264; 220/DIG. 6; 222/179; 222/185.1; 222/189.06; 222/509; 222/518; 222/608

[58] Field of Search ..... 15/264; 220/571, 220/DIG. 6, DIG. 28; 222/608, 179, 185.1, 189.06, 501, 509, 518

[56] References Cited

U.S. PATENT DOCUMENTS

| | | | |
|---|---|---|---|
| D. 226,681 | 4/1973 | Bard . | |
| 390,722 | 10/1888 | Toepfer . | |
| 415,010 | 11/1889 | Wiltse | 222/179 |
| 1,177,922 | 4/1916 | Brown . | |
| 1,236,156 | 8/1917 | Finnell . | |
| 1,278,281 | 9/1918 | Wuerdemann . | |
| 1,284,550 | 11/1918 | Apgar . | |
| 1,327,708 | 1/1920 | Guy . | |
| 1,767,840 | 6/1930 | Finnell . | |
| 3,045,252 | 7/1962 | Sorrells . | |
| 3,390,818 | 7/1968 | Yucus | 222/185.1 |
| 3,630,369 | 12/1971 | Nichols . | |
| 4,713,859 | 12/1987 | Smith . | |
| 4,716,619 | 1/1988 | Young . | |
| 4,798,307 | 1/1989 | Evrard . | |
| 4,815,160 | 3/1989 | Smith . | |
| 4,908,904 | 3/1990 | Smith . | |

FOREIGN PATENT DOCUMENTS

| | | | |
|---|---|---|---|
| 2678589 | 1/1993 | France | 222/179 |
| 1520839 | 7/1976 | United Kingdom . | |

*Primary Examiner*—David Scherbel
*Assistant Examiner*—Randall Chin
*Attorney, Agent, or Firm*—Richard B. O'Planick; Lisa B. Riedesel

[57] ABSTRACT

A portable cleaning container assembly having a foot activated valve assembly for selectively opening and closing a drain opening disposed in the bucket bottom wall. A directing member secured to the bucket bottom wall assists in directing the discharging cleaning solution from the drain opening to a floor drain or other drain means.

14 Claims, 7 Drawing Sheets

PORTABLE CLEANING CONTAINER HAVING FOOT ACTIVATED DRAIN

BACKGROUND OF THE INVENTION

1. Field of the Invention

The subject invention relates generally to the field of portable cleaning containers, and more particularly to portable cleaning containers having foot activated drain means.

2. The Prior Art

The use of portable cleaning containers including bucket like containers in connection with various activities including mopping floors is well known in the art. Typically such containers consist of a bucket like container, having wheels secured to the container thereby allowing the container to easily move across various surfaces. However, in order to empty these portable cleaning containers, most of the containers must be actually lifted by the user and the contents emptied into a sink or other receptacle containing a drain. Since a portable cleaning container is generally very bulky and cumbersome to lift even when it is empty, it is understandable why a cleaning container, filled with cleaning solution, is extremely difficult to lift and empty. There have been attempts made to design portable cleaning containers which assist the user in emptying the cleaning container. For example, some containers include a drain opening and stopper disposed in the side or bottom wall of the cleaning container, as illustrated in U.S. Pat. No. 2,712,668. This feature allows the user to move the cleaning container adjacent a floor drain, and by removing the stopper from the drain opening the cleaning container may be easily emptied. There are disadvantages with this particular design since the user has to physically remove the stopper by hand in order to empty the cleaning container. In addition, if the drain opening is located within the cleaning container interior, the user will be required to insert at least one of their hands into the dirty cleaning solution in order to remove the stopper from the drain opening.

Other cleaning containers have included drain means and a stopper disposed in the container bottom wall, whereby the user can control the movement of the stopper by hand activated controls, as illustrated in U.S. Pat. Nos. 4,815,160 and 4,908,904. While this embodiment allows the user to open the drain means without having to directly contact the cleaning liquid, there are limitations with design as well. Specifically, this container design also requires that the user have at least one, and perhaps both hands free, to control the hand activated knob which subsequently opens or closes the drain means. Thus, this requirement limits the user's ability to perform other tasks with their hands at the same time it is desirable to empty the cleaning container.

SUMMARY OF THE INVENTION

The present invention overcomes the deficiencies of the above described portable cleaning assemblies. The present and unique design of a portable cleaning assembly provides for a cleaning container having a drain opening located in a container bottom wall, and a valve assembly pivotably secured to the container bottom wall for controlling the opening and closing of the drain opening. The valve assembly is foot activated, which therefore allows the user to be actively performing other tasks with it is desirable to empty the cleaning container. The valve assembly consists of a stopper disposed in an interior portion of the container, and a foot activated pedal assembly. The stopper is positioned within the bucket interior and is oriented approximately above the drain opening. The remainder of the valve assembly is disposed between a pedal and the stopper, such that the movement of the pedal causes a resultant movement of the remainder of the valve assembly including the stopper. The valve assembly may also contain a directing member secured to the container bottom wall, approximately adjacent to the drain opening, for assisting in directing the discharge of liquid from the container. A removable filter may also be used to prevent larger debris from clogging the drain opening.

An object of the present invention is to provide a cleaning container which is easy for a user to empty and discharge the cleaning liquid and debris from the container.

Another object of the present invention is to provide a safe and efficient method of discharging the cleaning liquid from the cleaning container which minimizes the direct contact a user must have with the cleaning liquid.

A further object of the present invention is to provide a cleaning container which has foot activated valve means and is easy to manufacture and assemble.

A still further object of the present invention is to provide a cleaning container assembly which contains means for eliminating the discharge of debris mingled with the cleaning solution discharged through the drain opening.

Yet another object of the present invention is to provide a cleaning container assembly which can be easily cleaned following each use, thereby eliminating contaminants prior to storage of the cleaning container assembly.

Yet a still further object of the present invention is to provide a cleaning container assembly which contains a valve means which can be easily detached or attached to a container.

Still another object of the present invention is to provide a cleaning container assembly which is easy to store when not in use.

These and other objectives, which will be apparent to those skilled in the art, are achieved by a preferred embodiment which is described in detail below and which is illustrated by the accompanying drawings.

DESCRIPTION OF THE PREFERRED EMBODIMENT

Figure 1:
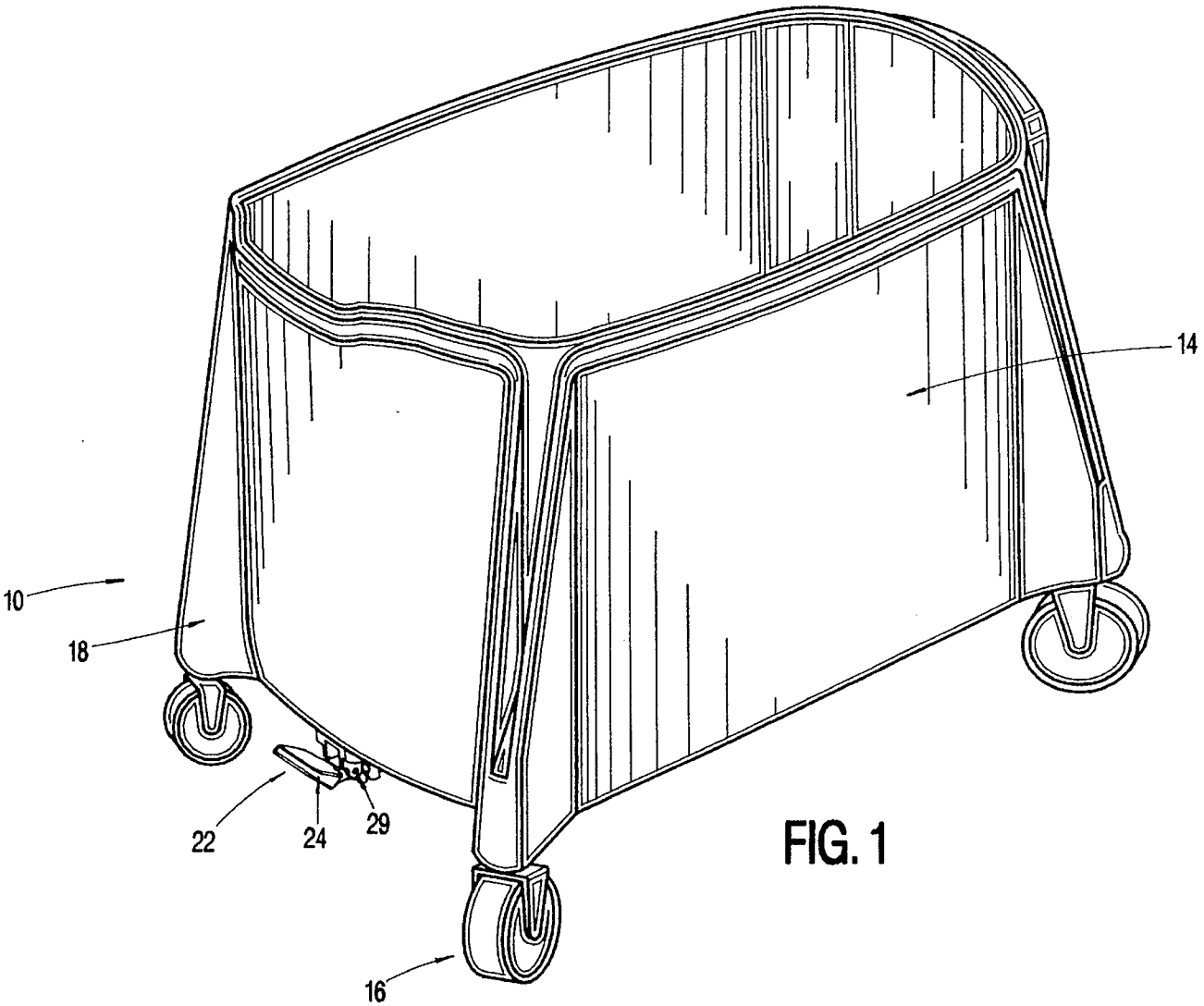
FIG. 1 is a front perspective view of the portable cleaning container assembly, in accordance with the present invention.

The portable cleaning container assembly is illustrated in FIGS. 1–7 and comprises a molded plastic container, bucket or other type receptacle for containing various types of liquid, solutions or other cleaning materials. The receptacle can be of a variety of sizes, shapes and capacities depending upon the intended uses and users of the cleaning container assembly. The cleaning container assembly generally consists of a bucket designated by a general reference number 10. The bucket 10 is preferably of a unitary construction and formed of materials including but not limited to foamed polyethylene.

The bucket 10 generally comprises a bottom wall 12 and a continuous side wall 14 which extends in a generally upwardly direction from the bottom wall 12, thereby forming a receptacle for holding a variety of materials including but not limited to cleaning liquids and solutions. Casters 16 may be press fit or otherwise secured within sockets disposed within the approximate corners of the side walls 14. The casters 16 may be secured by a variety of means including pins or screws (not shown) which extend through apertures (not shown) in the casters 16 and the side walls 14 or a leg member 18 protruding in an outwardly direction from the side wall 16. The casters 16 allow the cleaning container assembly to be entirely portable and easier to use.

Figure 2:
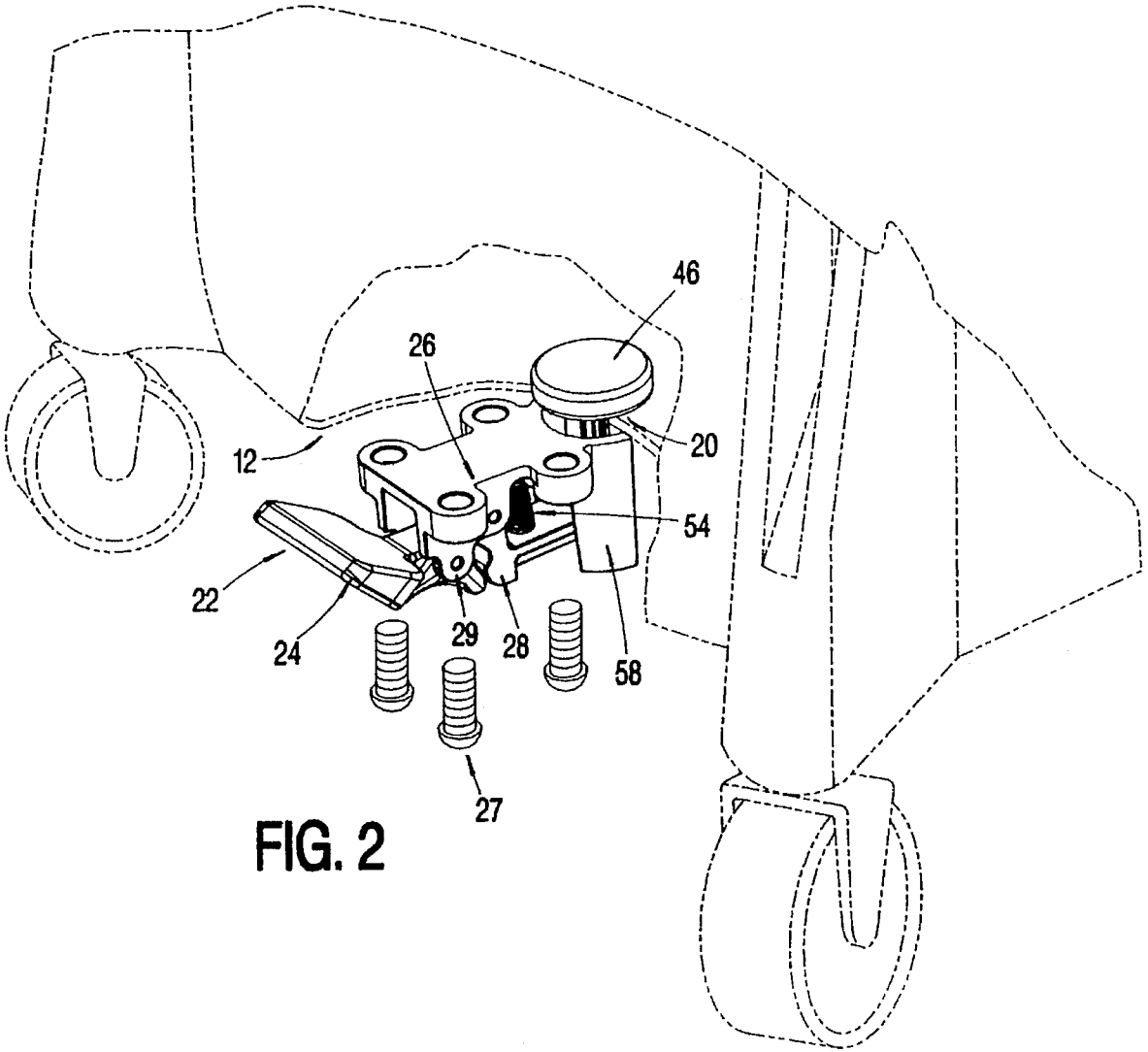
FIG. 2 is a from perspective view of the portable cleaning container assembly, illustrating the container in broken lines and the valve means in a closed position, in accordance with the present invention.
Figure 3:
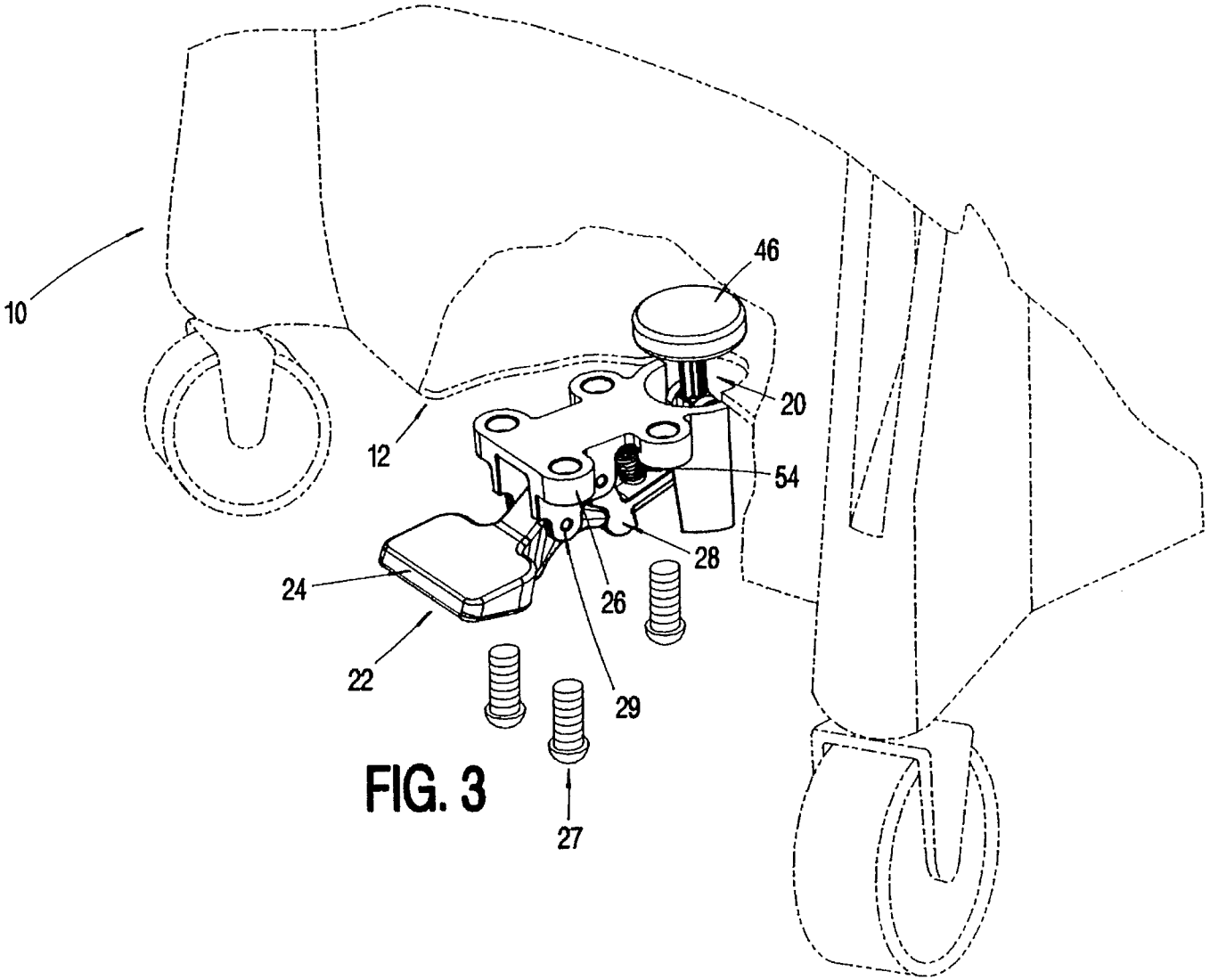
FIG. 3 is a front perspective view of the portable cleaning container assembly illustrating the container in broken lines and the valve means in an open position, in accordance with the present invention.
Figure 4:
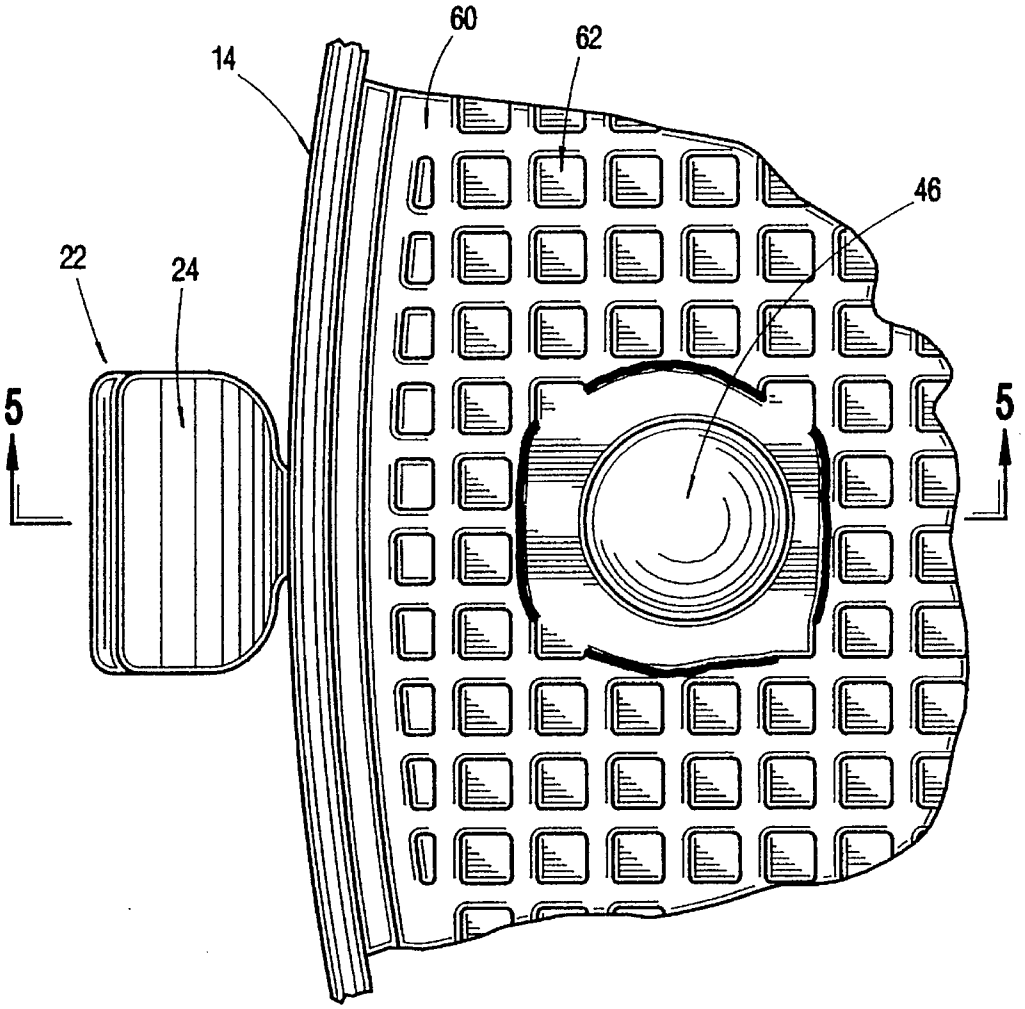
FIG. 4 is a fragmentary top view of the portable cleaning container assembly, in accordance with the present invention, illustrating the valve means in a closed position.
Figure 5:
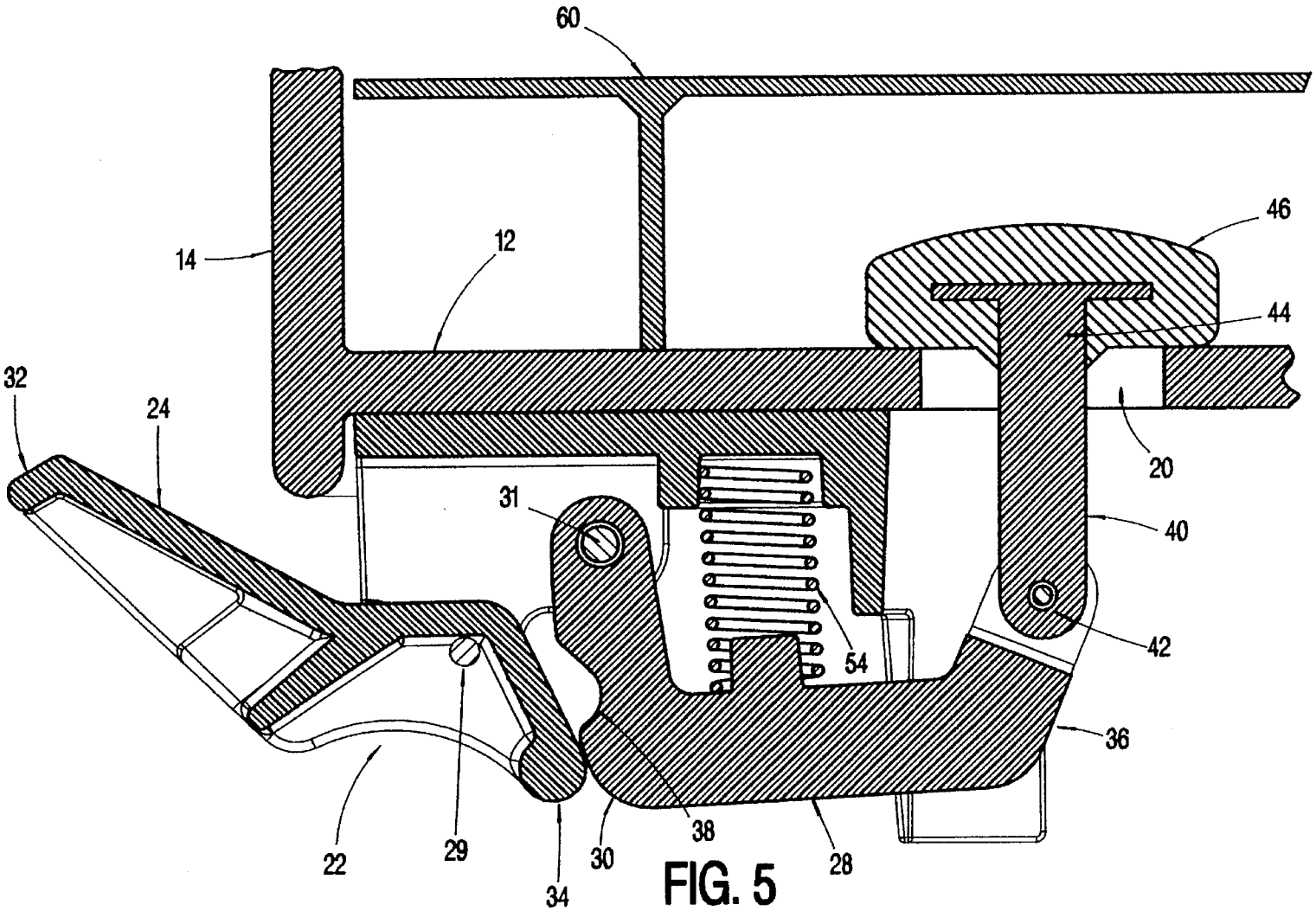
FIG. 5 is a cross-section of the portable cleaning container assembly taken along line 5—5 of FIG. 4.
Figure 6:
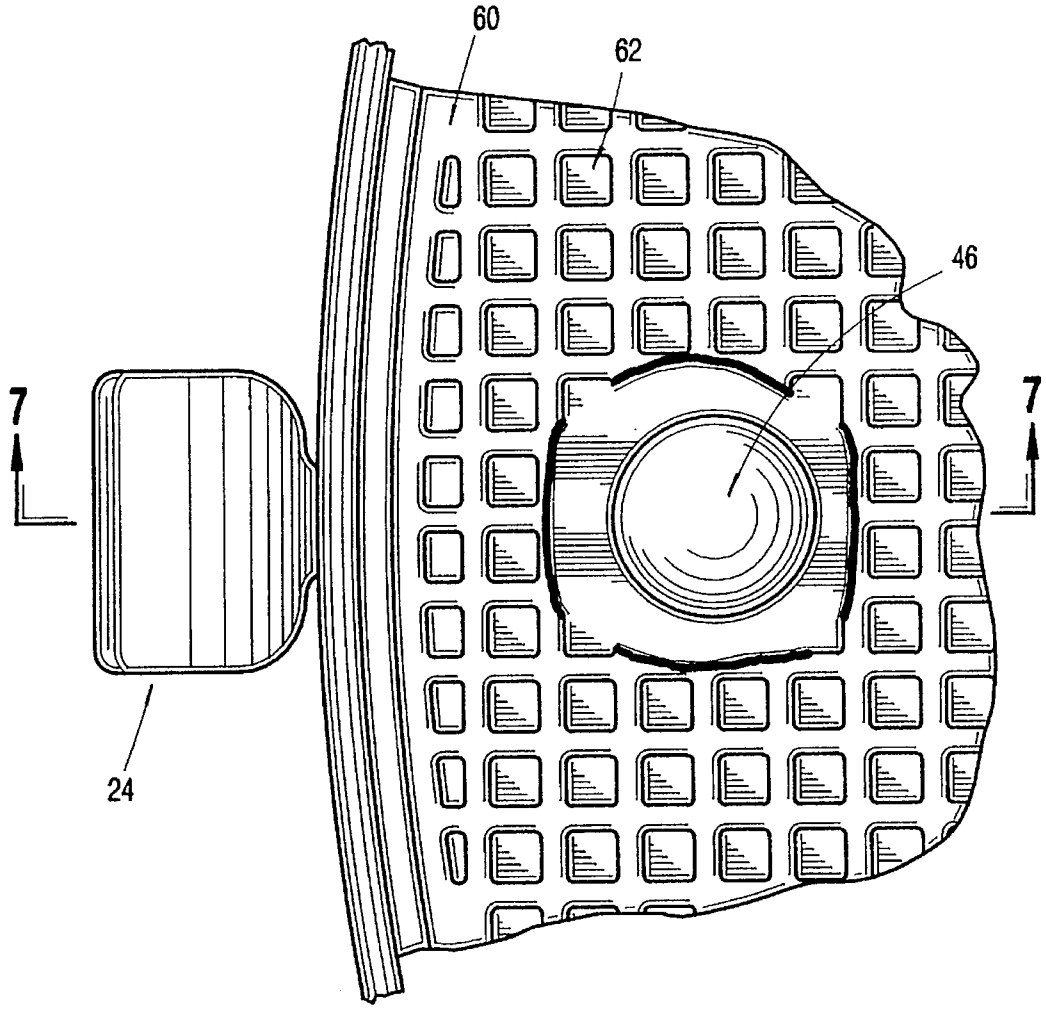
FIG. 6 is a fragmentary top view of the portable cleaning container assembly, in accordance with the present invention illustrating the valve means in an open position.
Figure 7:
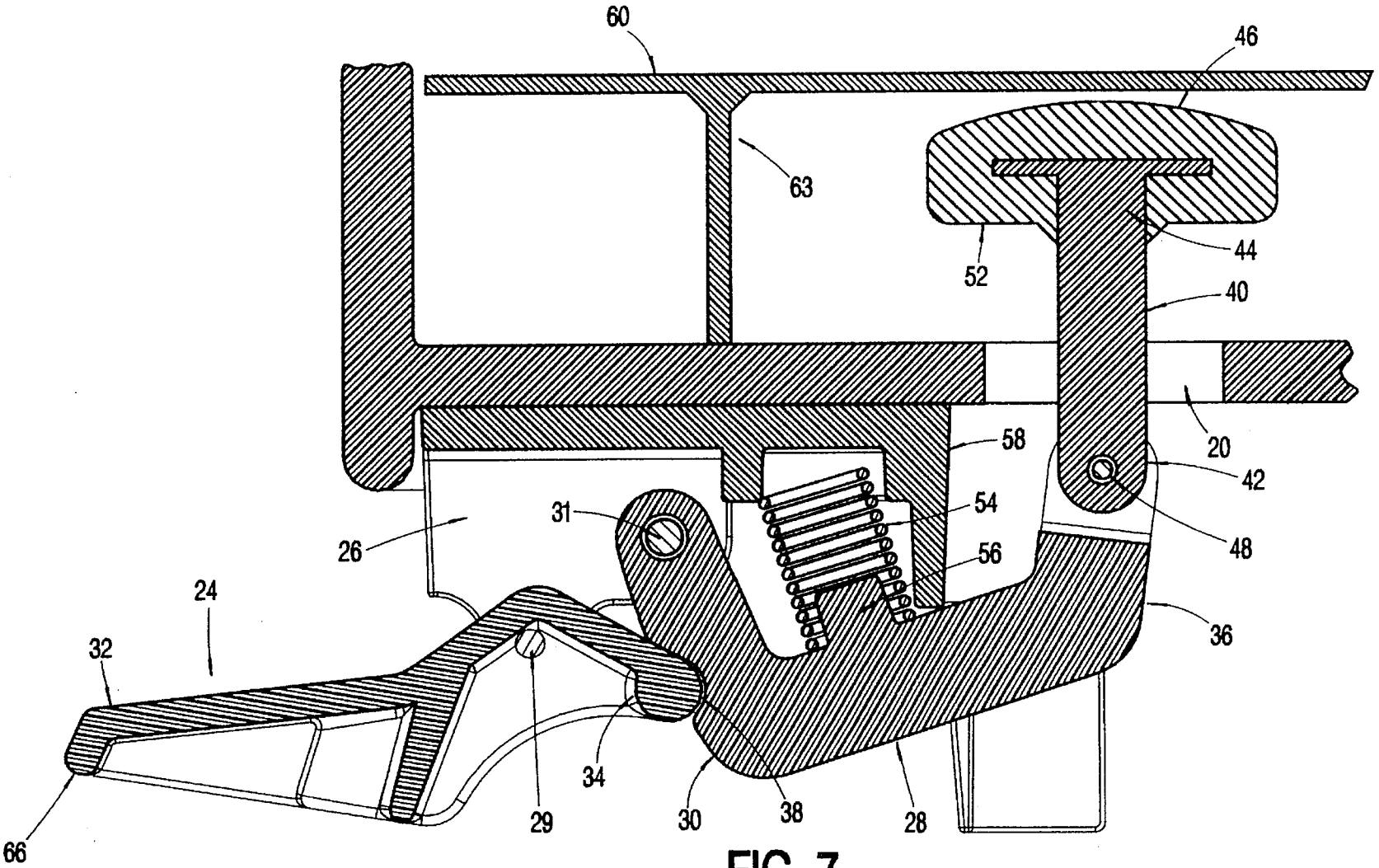
FIG. 7 is a cross section of the portable cleaning container assembly taken along the line 7—7 of FIG. 6.

As illustrated in FIGS. 2–7, the bottom wall 12 of the bucket 10 includes drain means such as a drain opening 20 disposed approximately in the center of the bottom wall 12. Foot activated valve means 22 are secured to the bucket 10 by a variety of means, as will be described in more detail later, such that the valve means 22 selectively opens and closes the drain opening 20 in response to the user's foot activation of a pedal 24. Specifically, when the container assembly is in use, and the user desires to maintain the cleaning solution within the bucket 10, the valve means 22 will occupy a closed position as illustrated in FIG. 2, 4 & 5. However, when the user desires to discharge the cleaning solution from the bucket 10, the valve means 22 can be selectively engaged thereby moving the valve means 22 from a closed to an open position, and subsequently allowing the discharge of cleaning solution or any other type of liquid through the drain opening 20 disposed in the bucket bottom wall 12, as illustrated in FIGS. 3, 6 & 7. Thus, the present invention allows a user to empty a bucket 10 without bending, stooping, or lifting the bucket 10, or requiring the user to directly contact the cleaning solution or other liquid.

FIGS. 1–7 illustrate the foot activated valve means 22 secured to an exterior of the bucket 10. The valve means 22 includes and is controlled by the pedal 24, which may be easily activated by a user's foot. The pedal 24 may be of a variety of shapes or sizes, however, the pedal 24 as illustrated in the present invention is generally semi-circular in shape, similar in shape to the from portion of a user's foot. As illustrated clearly in FIGS. 2 & 3, the pedal 24 is pivotably secured to a bracket member 26, which protrudes in a generally downwardly direction from the bucket bottom wall 12. The bracket member 26 may be secured to the bucket bottom wall 12 by a variety of means including pins or screws 27 extending through apertures in the approximate corners of the bracket member 26. The pins and screws 27 are sized such that they will not protrude through the bucket bottom wall 12. The bracket member 26 and pedal 24 may be pivotably secured together via pin or rivet means 29 disposed through a generally front portion of both the bracket member 26 and the pedal 24. Thus, the pedal 24 is pivotably connected to the bracket member 26 such that the pedal 24 extends in a generally outwardly direction from the bracket member 26, and is oriented at an angle approximately 45 degrees with respect to the bucket side wall 14. In addition, the bracket member 26 is secured to the bucket bottom wall 12 such that the outer edges of the bracket 26 does not extend beyond the bucket side wall 14, thereby ensuring the cleaning assembly is easily cleaned.

FIGS. 2, 3, & 5 illustrate a generally U shaped support arm 28, wherein a first side 30 of the U shaped support arm 28 is pivotably secured to the bracket member 26 by various securing means including a bolt or pin member 31. The pedal 24 and the support arm 28 are pivotably secured to the bracket member 26 at two different locations, and the orientation of the pedal 24 and support arm 28 is such that at all times the pedal 24 is in direct contact with the support arm 28 and engages the support arm first side 30 as the support arm 28 is raised in a generally upwardly direction with respect to the bucket bottom wall 14. Specifically, when a user desires to open the drain opening 20, the user will depress a first end 32 of the pedal 24, which subsequently causes a second end 34 of the pedal 24 to engage the support arm first side, 30, thereby raising the support arm second side 36 in a generally upwardly direction until the pedal second end 34 is engaged in a generally C shaped notch 38 disposed within the approximate center of the support arm first side 30. Once the pedal second end 34 is engaged in the notch 38, the pedal 24 can not be easily dislodged from the notch 38 in the support arm first side 30. Therefore, the support arm 28 is essentially locked in a generally extended and raised position when the pedal second end 34 is engaged within the notch 38.

An extension member 40 having a first 42 and a second 44 end is disposed between the support arm 28 and an elastomeric stopper 46. The extension member first end 42 is pivotably secured to the support arm second side 36. The extension member 40 may be secured to the support arm second side 36 by a variety of different securing means, thereby providing the support arm 28 with additional height. FIGS. 5 & 7 illustrate pin means, such as a pin, screw or rivet 48, which may be used to pivotably secure together the extension member first end 42 and support arm second side 36.

The extension member second end 44 may be sized to be received in a cavity within the elastomeric stopper 46. The elastomeric stopper 46 may be secured to the extension member second end 44 by a variety of securing means. Alternatively, the elastomeric stopper may be molded directly around the extension member 40. As illustrated in FIGS. 5 & 7, the elastomeric stopper is molded to the extension member second end 44. The elastomeric stopper bottom side 52 is generally conical in shape and therefore provides for a sealing engagement between the elastomeric stopper 46 and the interior bucket bottom wall 12 surrounding the drain opening 20.

The diameter of the extension member 40 is of a dimension such that it can easily move in an upwardly and a downwardly direction within the drain opening 20 disposed within the bucket bottom wall 12. It is necessary for the extension member 40 to be able to easily move within the drain opening 20 since the movement of the extension member 40 causes the lowering and raising of the elastomeric stopper 46 with respect to the interior of the bucket bottom wall 12 as illustrated in FIGS. 5 & 7, respectively. Therefore, as the extension member 40 is oriented in the upwardly extended position as illustrated in FIG. 7, cleaning solution and/or other liquid flows around and contacts the extension member 40 as the solution is discharged through the drain opening 20.

Specifically, FIG. 5 illustrates the stopper 46 approximately adjacent and sealingly engaging the interior bucket bottom wall 12 approximately adjacent the drain opening 20, and FIG. 7 illustrates the stopper 46 oriented approximately ½ to ¾ inch directly above the drain opening 20. The distance between the stopper 46 and the drain opening 20 disposed in the bucket bottom wall 12 when the extension member 40 is occupying a fully extended position allows the correct amount of liquid to flow out the bucket drain opening 20. It is important to maintain this distance between the stopper bottom side 52 and the bucket bottom wall 12 to help ensure that a proper amount of liquid is discharged through the bucket drain opening 20. The average floor drain (not shown) will allow a flow of between approximately 10 to 14 gallons per minute, and therefore, the bucket drain opening 20 should only allow the discharge of approximately 7–9 gallons per minute. Thus, the distance between the stopper bottom side 52 and the bucket bottom wall 12, and the size of the drain opening 20 helps to ensure that the correct amount of liquid is discharged through the drain opening 20.

FIGS. 2, 3, 5, & 7 also clearly illustrate spring means 54 disposed between the approximate center portion of the support arm 28 and the bracket member 26 secured to the exterior bucket bottom wall 12. The spring means 54 is confined between an aperture within the bracket member 26 and a protrusion 56 extending in a generally upwardly direction from the approximate center of the support arm 28, and the spring means 54 may be in direct contact with the exterior bucket bottom wall 12 as illustrated in FIG. 5. The spring means 54 assists the pedal 24 in changing positions from a first position to a second position. As discussed earlier, the pedal 24 changes positions depending upon whether the user desires the valve means 22 to be open or closed. Specifically, when the pedal 24 is occupying a first position, the drain opening 20 is closed, and when the pedal 24 is occupying a second position, the drain opening 20 is open.

The cleaning container assembly also includes directing means which may be secured to the valve assembly 22 for assisting in directing the discharging liquid from the bucket 10. Specifically, the directing means includes a generally C shaped directing member 58 extending in a downwardly direction from the bracket member 26 approximately adjacent to the drain opening 20, as illustrated in FIG. 5. The bracket member 26 and directing member 58 may be a one piece member or alternatively two separate pieces secured together. One of the purposes of the directing member 58 is to assist in preventing liquid discharging from the drain opening 20 from coming in direct contact with the valve assembly 22 including but not limited to the spring means 54, bracket member 26, and pedal 24. In addition, the directing member 58 assists in guiding the liquid being discharged through the drain opening 20 in a generally downwardly direction. Thus, the directing member 58 will help ensure that once a user has completed the use of the bucket 10 and desires to empty the bucket 10 of the cleaning solution and other debris, the liquid can be discharged through the drain opening 20 and guided by the directing member 58 to a floor drain or other drain means.

The cleaning container assembly may also include a screen or removable filter 60 which when used in connection with the subject cleaning container assembly will assist in preventing large debris from entering and getting caught between the stopper 46 and drain opening 20, and within the drain opening 20. Openings 62 disposed within the filter 60, are sized to prevent the flow through of debris which could get lodged within the drain opening 20. Smaller size debris which could easily pass between the stopper 46 and drain opening 20 and subsequently through the drain opening 20 will be able to pass through the filter openings 62.

The filter 60 may be supported within the interior of the bucket 10 by protrusions 63 emanating from the bottom wall of the filter 60. The protrusions 63 are of such a height that the filter 60 is oriented above the stopper 46 and drain opening 20, and does not interfere with the movement of the stopper 46 between an open and a closed position. Since the filter 60 is not permanently secured to the bucket bottom wall 12, the filter 60 can easily be removed and the larger debris remaining on the top wall of the filter 60 discarded in a waste receptacle. The filter 60 can subsequently be washed and/or rinsed and returned to the bucket interior.

In the event the user desires to use a wringer (not shown) with the subject cleaning container assembly the wringer assembly can be mounted between the bucket side walls 14 in a conventional manner. When the user desires to remove the filter 60 for cleaning, the wringer will have to be removed from the bucket side walls 14.

In operation, at such time as the cleaning container assembly is in use the valve means 22 will be closed and the pedal 24 will be occupying a first position. Thus, the drain opening 20 will be closed since the elastomeric stopper 46 will be sealingly engaging the bucket bottom wall 12 adjacent the drain opening 20. The bucket 10 can then be filled with cleaning solution, water or other materials. Throughout the cleaning process, a mop (not shown) may be introduced into the cleaning solution and excess liquid may be removed from the mop by inserting the mop into the wringer. Each time the mop is introduced into the cleaning solution, debris may also be introduced into the cleaning solution. The filter 60 will help to ensure that as debris becomes introduced into the cleaning solution, the debris sized larger than the filter openings 62 will come to rest on the top wall of the filter 60 and will be remain separated from the drain opening 20.

When the user has finished using the cleaning container assembly and desires to empty the bucket 10 of the cleaning solution and debris, the user must open the valve means 22. To open the valve means 22 the user must change the pedal 24 position from a first to a second position, which is accomplished by depressing the pedal first end 32 in a generally downwardly direction. As the pedal first end 32 begins to move in a generally downwardly direction, the pedal second end 34 begins to move in a generally upwardly direction as illustrated in FIGS. 5 & 7. The pedal second end 34 continues to move in a generally upwardly direction until it is engaged by the notch 38 in the support arm 28. Meanwhile as the pedal 24 is moving, the support arm 28 and extension member 40 are also moving in a generally upwardly direction thereby raising the elastomeric stopper 46 a defined distance from the bucket bottom wall 12. Thus, space exists between the bucket bottom wall 12 and the elastomeric stopper 46, and the cleaning solution can be discharged from the bucket 10 through the drain opening 20, and subsequently guided by the directing member.

Prior to opening the valve means 22, the user may elect to move the cleaning container assembly to a location such that the bucket 10, specifically the bucket drain opening 20, is oriented approximately directly above a floor drain. Thus the cleaning solution can be discharged through the bucket drain opening 20, and guided by the directing member 58 directly into a floor drain.

As cleaning solution is being discharged through the drain opening 20, the larger size debris will be retained on the top wall of the filter 60, therefore preventing the debris from becoming lodged within the drain opening 20. After all the cleaning solution has been discharged through the drain opening 20, the wringer may be used to eliminate any remaining liquid from the mop, and the wringer subsequently removed from the bucket side walls 14. The filter 60 may then be removed and any debris on the top wall of the filter 60 emptied into an appropriate waste receptacle. The filter 60 can then be returned to the bucket 10, and water used to flush the bucket 10 and filter 60 to force any remaining debris onto the top wall of the filter 60 for a second removal and disposal of the debris. The filter 60 can then be replaced into the bucket 10 and the user can subsequently close the valve means 22.

In order for the valve means 22 to occupy a closed position, the pedal 24 must be occupying a first position rather than a second position. Therefore the user must push the bottom side 66 of the pedal first end 32 in a generally upwardly direction. This movement will subsequently disengage the pedal second end 34 from the notch 38 in the support arm first side 30. The support arm 28 and extension member 40 will subsequently be lowered, which also lowers the elastomeric stopper 46 such that the elastomeric stopper 46 sealingly engages the bucket bottom wall 12 thereby preventing any cleaning solution from discharging through the drain opening 20.

By providing a foot activated pedal 24 to control opening and closing of the drain opening 20 disposed in the bucket bottom wall 12, it is apparent the cleaning solution within the bucket 10 can be emptied without tilting or lifting the bucket 10. In addition, since the user is not required to manually remove a stopper from a drain opening within a bucket interior the user does not have to come into direct contact with any cleaning solution. Thus, a bucket can be emptied in a safe way without hurting the user or without requiring the user to have to handle any unclean components by hand.

It will be clear that the present invention is well adapted to carry out the objects and attain the ends and advantages mentioned as well as those inherent within. While the above describes the preferred embodiment of the subject invention, the invention is not intended to be so confined. Other embodiments apparent to those skilled in the art, which utilize the teachings hereof, are intended to be within the scope and spirit of the present invention.

What is claimed is:

1. A container assembly comprising: a bucket having a bottom wall and a continuous side wall extending in a generally upwardly direction from said bottom wall;

wheel means secured to said bucket for permitting selective movement of said container assembly;

a drain opening disposed in said bucket bottom wall;

stopper means disposed in an interior of said bucket and positioned to selectively open or close said drain opening;

a foot pedal;

stopper drive means disposed between said foot pedal and said stopper means, said foot pedal being connected to said stopper drive means, said stopper drive means secured to said bucket and oriented such that the movement of said foot pedal produces a resultant movement of said stopper means with respect to said drain opening.

2. A container assembly according to claim 1, said container assembly further comprising directing means oriented adjacent an exterior of said bucket for assisting in directing liquid discharging from said drain opening.

3. A container assembly according to claim 1, said container assembly further comprising a filter oriented approximately adjacent and parallel to said bucket bottom wall in said bucket interior.

4. A container assembly according to claim 3, said filter further comprising protrusions extending from a bottom wall of said filter for supporting said filter a defined distance from said bucket bottom wall.

5. A container assembly comprising: a bucket having a bottom wall and a continuous side wall extending in a generally upwardly direction from said bottom wall;

a drain oriented within an interior portion of said bucket bottom wall, an elastomeric stopper oriented within said interior portion of said bucket and disposed approximately above said drain;

stopper drive means for assisting said stopper in opening and closing said drain, said stopper drive means secured to said bucket approximately adjacent an exterior portion of said bucket bottom wall and secured to said stopper, said stopper rising in an upwardly vertical direction in response to vertical depression of said stopper drive means by a user's foot thereby opening said drain.

6. A container assembly according to claim 5, said bucket further comprising directing means, protruding in a generally downwardly direction from an exterior of said bucket adjacent said drain, for directing the discharge of liquid from said drain in a generally downwardly direction from said drain.

7. A container assembly according to claim 5, wherein said stopper drive means comprises:

a pedal pivotably secured to said bucket;

a pedal support arm disposed between said pedal and said elastomeric stopper, said pedal support arm for assisting said elastomeric stopper rising in an upwardly vertical direction in response to said vertical depression of said stopper drive means.

8. A container assembly according to claim 7, said container assembly further comprising wheel means secured to said bucket for permitting selective movement of said container assembly.

9. A container assembly comprising:

a bucket having a bottom wall and a continuous side wall extending in a generally upwardly direction from said bottom wall;

a drain opening oriented adjacent said bucket bottom wall;

an elastomeric stopper oriented within an interior portion of said bucket and disposed approximately above said drain opening;

stopper drive means for assisting said stopper in opening and closing said drain opening, said stopper drive means secured adjacent an exterior portion of said bucket bottom wall, said stopper drive means activated by a user's foot;

said stopper drive means further comprising a pedal pivotably secured to said bucket, and a pedal support arm disposed between said pedal and said elastomeric stopper, said pedal support arm for assisting in the movement of said elastomeric stopper in a generally upwardly direction generally away from said drain opening in response to the depression of said pedal.

10. A container assembly comprising:

a bucket having a bottom wall and a continuous side wall extending in a generally upwardly direction from said bottom wall;

a drain opening oriented adjacent said bucket bottom wall;

an elastomeric stopper oriented within an interior portion of said bucket and disposed approximately above said drain opening;

stopper drive means for assisting said stopper in opening and closing said drain opening;

said stopper drive means secured adjacent an exterior portion of said bucket bottom wall and activated by a user's foot;

said stopper drive means further comprising a pedal pivotably secured to said bucket, a pedal support arm disposed between said pedal and said elastomeric stopper for assisting in the movement of said elastomeric stopper in response to the movement of said pedal, and spring means disposed approximately between said pedal support arm and an exterior of said bottom wall of said bucket, said spring means for assisting with the movement of said elastomeric stopper with respect to said drain opening.

11. A cleaning assembly comprising:

a bucket for containing a cleaning solution, the bucket comprising a bottom wall and a side wall extending in a generally upwardly direction from said bottom wall;

wheel means secured to an exterior of said bucket for permitting selective movement of said cleaning assembly;

a drain opening oriented in said bucket bottom wall;

an elastomeric stopper disposed in an interior of said bucket and oriented approximately adjacent said drain opening;

stopper drive means supporting said stopper and for assisting in the movement of said stopper with respect to said drain opening, said stopper drive means comprising:

bracket means, projecting in a generally downwardly direction from said bucket bottom wall, for pivotably securing a pedal and a pedal support arm;

said pedal support arm disposed between said pedal and said stopper, said pedal support arm assisting in the movement of said stopper in response to movement of said pedal;

directing means, extending in a generally downwardly direction from said bucket bottom wall approximately adjacent said drain opening, for directing the cleaning solution discharging from said drain opening in a generally downwardly direction;

a filter in said bucket interior, said filter disposed approximately parallel to said bucket bottom wall, said filter including supporting means for supporting said filter a distance above said bucket bottom wall such that said filter does not interfere with the movement of said stopper drive means and said stopper.

12. A portable container assembly comprising:

a bucket including a drain opening oriented in a bucket bottom wall;

vertical foot activated valve means for selectively closing and opening said drain opening, said vertically foot activated valve means comprising at least a first member and a second member, said first member disposed in an interior portion of said bucket and a second member secured to an exterior portion of said bucket, wherein said first member will rise in a vertically upwardly direction in response to vertical depression of said second member by a user's foot.

13. A portable container assembly comprising:

a bucket including a drain opening oriented in a bucket bottom wall;

foot activated valve means for selectively closing and opening said drain opening, said foot activated valve means comprising at least a first member and a second member, said first member disposed in a interior portion of said bucket and a second member secured to an exterior portion of said bucket;

said second member comprises a pedal and stopper drive means, said pedal secured to an exterior portion of said bucket and said stopper drive means disposed between said pedal and said first member for supporting said first member and for assisting said first member in selective vertical movement (of said first member) with respect to said drain opening;

said pedal disposed adjacent to said stopper drive means such that movement of said pedal causes movement of said stopper drive means whereby said first member is subject to said vertical movement with respect to said drain opening.

14. A portable container assembly according to claim 13, said portable container assembly further comprising:

a bracket secured to said bucket bottom wall;

said pedal and said stopped drive means each separately pivotably connected to said bracket.

* * * * *